US007059904B2

(12) United States Patent
Konda

(10) Patent No.: US 7,059,904 B2
(45) Date of Patent: Jun. 13, 2006

(54) RELAY CONNECTOR

(75) Inventor: Kazumoto Konda, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/882,299

(22) Filed: Jul. 2, 2004

(65) Prior Publication Data

US 2005/0037666 A1 Feb. 17, 2005

(30) Foreign Application Priority Data

Jul. 3, 2003 (JP) ..... P2003-191348

(51) Int. Cl.
*H01R 13/648* (2006.01)

(52) U.S. Cl. ..... 439/607; 439/675; 439/578

(58) Field of Classification Search ..... 439/607–610, 439/108, 660, 628, 101, 105, 88, 90, 654, 439/578–585, 675, 78, 74, 81, 83, 638–640, 439/63, 222, 901, 904, 908, 34–35
See application file for complete search history.

(56) References Cited

U.S. PATENT DOCUMENTS

| | | | | |
|---|---|---|---|---|
| 4,060,298 | A * | 11/1977 | Gearin | 439/289 |
| 4,906,200 | A * | 3/1990 | Miyake | 439/101 |
| 5,062,808 | A * | 11/1991 | Hosler, Sr. | 439/580 |
| 5,256,081 | A * | 10/1993 | Didier | 439/464 |
| 5,330,371 | A * | 7/1994 | Andrews | 439/579 |
| 5,820,390 | A * | 10/1998 | Takamoto et al. | 439/78 |
| 6,227,908 | B1 * | 5/2001 | Aumeier et al. | 439/607 |

FOREIGN PATENT DOCUMENTS

| | | |
|---|---|---|
| JP | A 8-250219 | 9/1996 |
| JP | A 9-161892 | 6/1997 |

* cited by examiner

*Primary Examiner*—Truc T. Nguyen
*Assistant Examiner*—Edwin A. Leon
(74) *Attorney, Agent, or Firm*—Oliff & Berridge, PLC

(57) ABSTRACT

A relay connector includes a relay terminal metal fitting including a connection part to be connected with the apparatus-side terminal metal fitting and a connection part to be connected with the wire-side terminal metal fitting and a relay housing an engagement part to be engaged with the apparatus-side housing and an engagement part to be engaged with the wire-side housing. when operator cannot reach the apparatus, the operator can connect the relay connector to the apparatus side connector and then the relay connector is connected to the wire side connector.

14 Claims, 12 Drawing Sheets

RELAY CONNECTOR

BACKGROUND OF THE INVENTION

1. Field of the Invention

The present invention relates to a relay connector which can be assembled between an apparatus and a wire harness.

2. Description of the Related Art

In an electric car, as a measure to connect a wire harness to an apparatus (such as a motor or an inverter), a wire-side connector that is connected with the wire of the wire harness is connected with an apparatus-side connector that is directly connected with the apparatus, thereby connecting the terminal metal fittings of the two connectors by the engagement of male and female parts (See JP-A-9-161892, for example).

In general, space saving is essential in automobile designing. Therefore, there are cases in which an apparatus-side connector is forced to be positioned out of the reach of the operator due to constraints of layout.

One solution for this is to extend the apparatus-side connector to a position within easy reach of the operator by modifying the configuration of the apparatus. However, in the case of trying to share the same apparatus among different types of automobiles for cost reduction, the shape-changed part of an extended apparatus-side connector can be useless or obtrusive in space in other types of automobiles. Therefore, it is preferable that an apparatus shared among different types of automobiles be simplified in shape and miniaturized.

SUMMARY OF THE INVENTION

It is an object of the invention to provide a relay connector in which a wire-side connector can be connected to an apparatus-side connector without changing the shape of the apparatus-side connector.

According to one aspect of the invention, a relay connector including: an apparatus-side connector which is fixed to an apparatus and which holds an apparatus-side terminal metal fitting in an apparatus-side housing; and a wire-side connector which holds a wire-side terminal connected to a wire in a wire-side housing, a relay terminal metal fitting provided at both ends of the relay terminal metal fitting with a connection part to be connected with the apparatus-side terminal metal fitting and a connection part to be connected with the wire-side terminal metal fitting; a relay housing which houses the relay terminal metal fitting and which is provided at both ends of the relay housing with an engagement part to be engaged with the apparatus-side housing and an engagement part to be engaged with the wire-side housing; and a relay shield shell accommodating the relay housing, and provided at both ends of the relay shield shell with a contact part to be contacted with the apparatus-side shield shell formed on the apparatus and a contact part to be contacted with the wire-side shield shell which accommodates the wire-side housing.

When one end of the relay connector of the present invention is connected to an apparatus-side connector, and the other end of the relay connector is within reach of the operator, even if the apparatus is positioned out of the reach of the operator, the wire-side connector can be connected to the apparatus-side connector without changing the configurations and structures of the apparatus and the apparatus-side connector.

According to another aspect of the invention, the terminal metal fitting includes a terminal main body. A first connection part of the connection part is formed at one end of the terminal main body. The first connection part has a male configuration. A second connection part of the connection is formed at the other end of the terminal main body. The second connection part has a female configuration. The relay housing is configured by combining a first accommodator which accommodates the terminal main body and the first connection part with the male configuration in a penetrated state, and a second accommodator which accommodates the second connection part with the female configuration.

In the case where a relay terminal metal fitting includes a long and narrow terminal main body, a male connection part formed at one end of the terminal main body, and a female connection part formed at the other end of the terminal main body, if the relay terminal metal fitting is intended to be housed into a relay housing with a one-piece structure, it is necessary that the relay housing contain a large insertion space for inserting the female connection part thereinto. This causes the long and narrow terminal main body to rattle inside the insertion space. However, the relay housing is divided into a first and a second accommodator, and makes the second accommodator accommodate the female connection part and also makes the first accommodator accommodate the terminal main body and the male connection part in an inserted state, thereby preventing the rattling of the terminal main body.

According to another aspect of the invention, the relay shield shell has a penetration space for housing the relay housing. The first accommodator which has been assembled to the relay shield shell from one end side of the penetration space and the second accommodator which has been assembled to the relay shield shell from the other end side of the penetration space are combined with each other in a state of sandwiching the relay shield shell.

The first accommodator and the second accommodator are combined with each other while sandwiching the relay shield shell, so that it is unnecessary to use a lock structure for controlling the independent separation of these accommodators from the relay shield shell.

According to another aspect of the invention, the first accommodator and the second accommodator are kept in a combined state by locking between a bending lock piece which is provided in one of the first accommodator and the second accommodator and which is elastically bendable, and a lock part provided in the other accommodator.

The device for keeping the two accommodators in a combined state is configured by a lock structure having a bending lock piece and a lock part. This can set the accommodators in a combined state with a single motion, and the combined state can be released only by detaching the bending lock piece from the lock part by elastically bending the bending lock piece.

According to another aspect of the invention, the bending lock piece and the lock part are positioned outside the relay shield shell in a state in which the relay housing is assembled to the relay shield shell.

The bending lock piece and the lock part are disposed outside the relay shield shell, so that it is simplified to detach the bending lock piece from the lock part.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Figure 1:
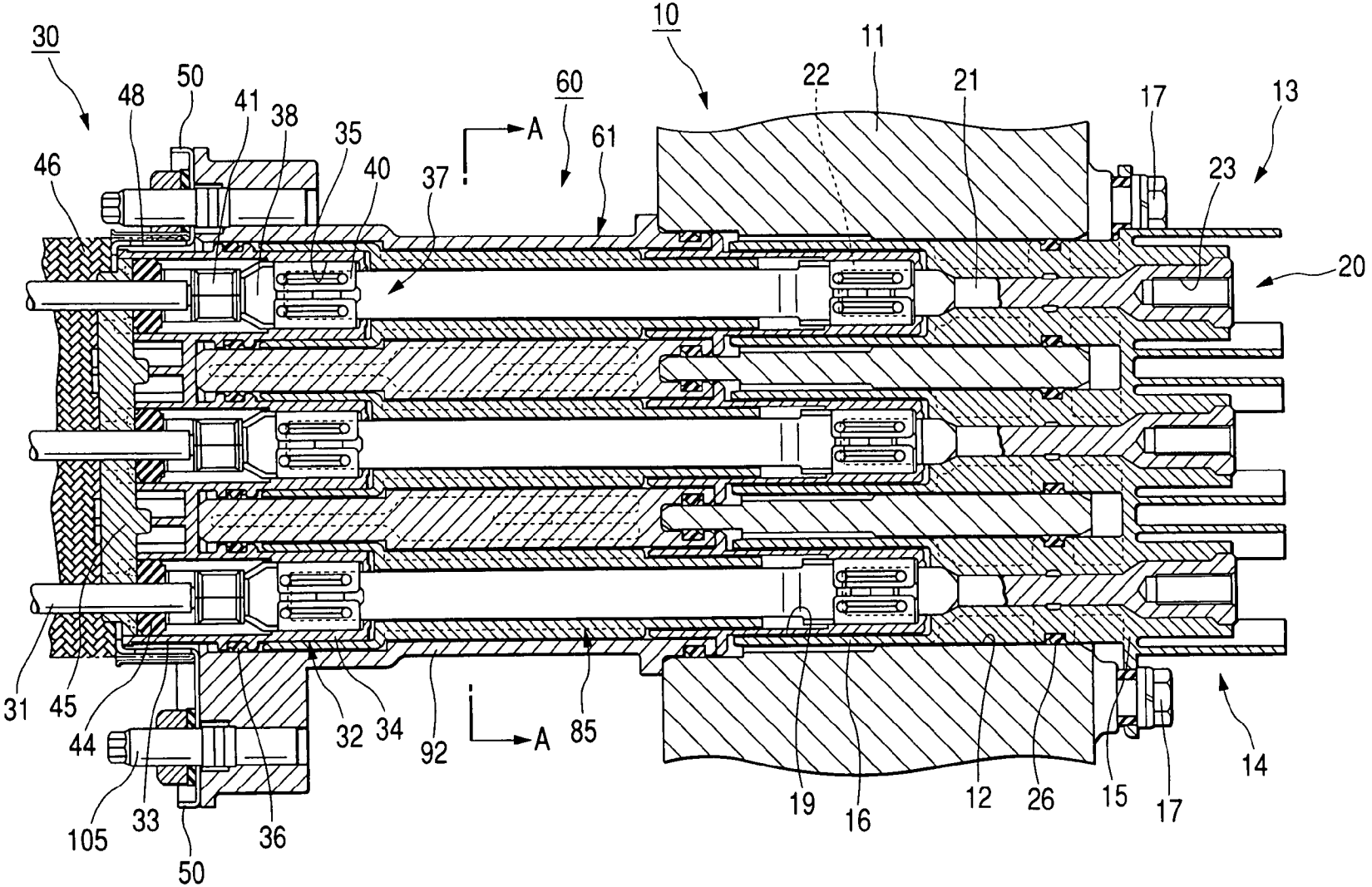
FIG. 1 is a horizontal cross sectional view showing a state in which an apparatus-side connector and a wire-side connector are connected with each other via a relay connector in Embodiment 1.
Figure 2:
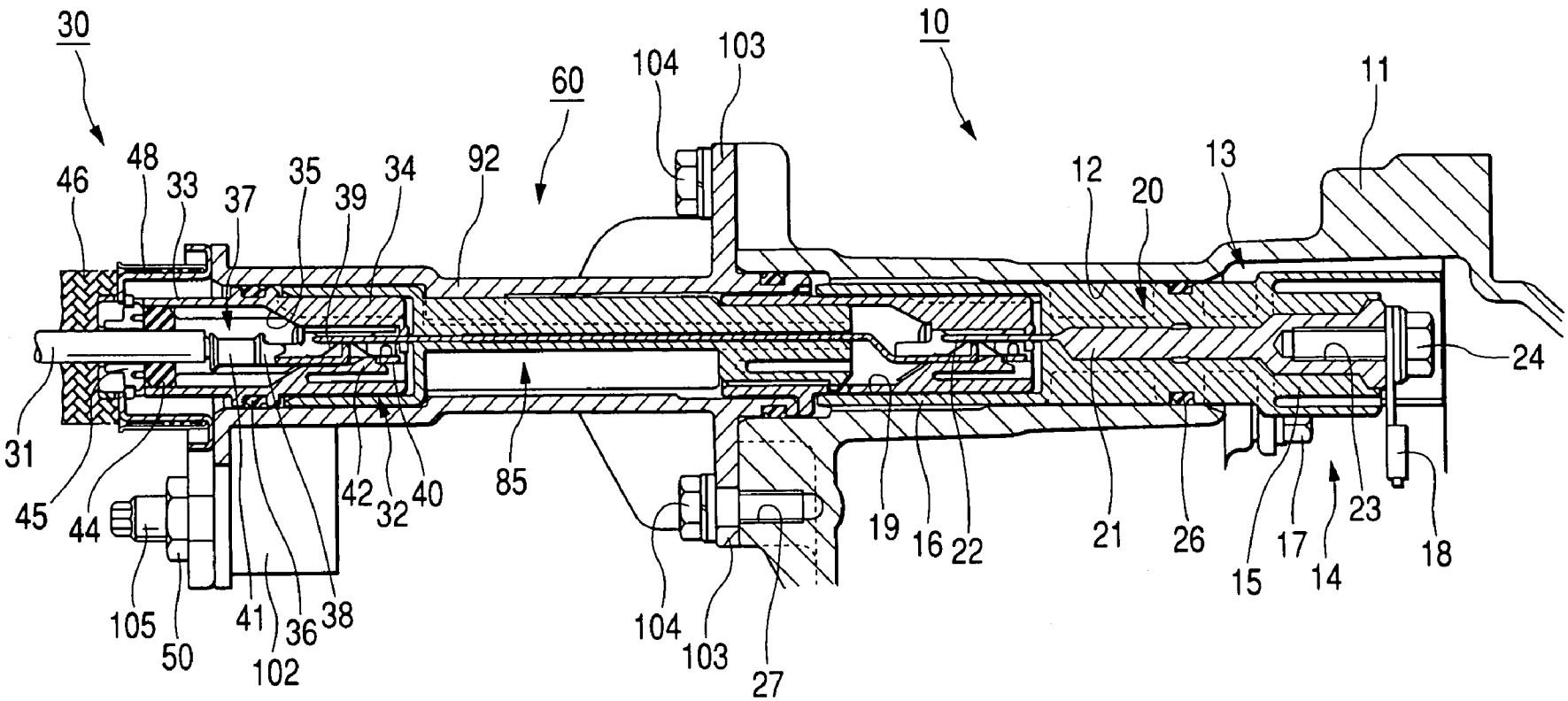
FIG. 2 is a vertical cross sectional view showing a state in which the apparatus-side connector and the wire-side connector are connected with each other via the relay connector.
Figure 3:
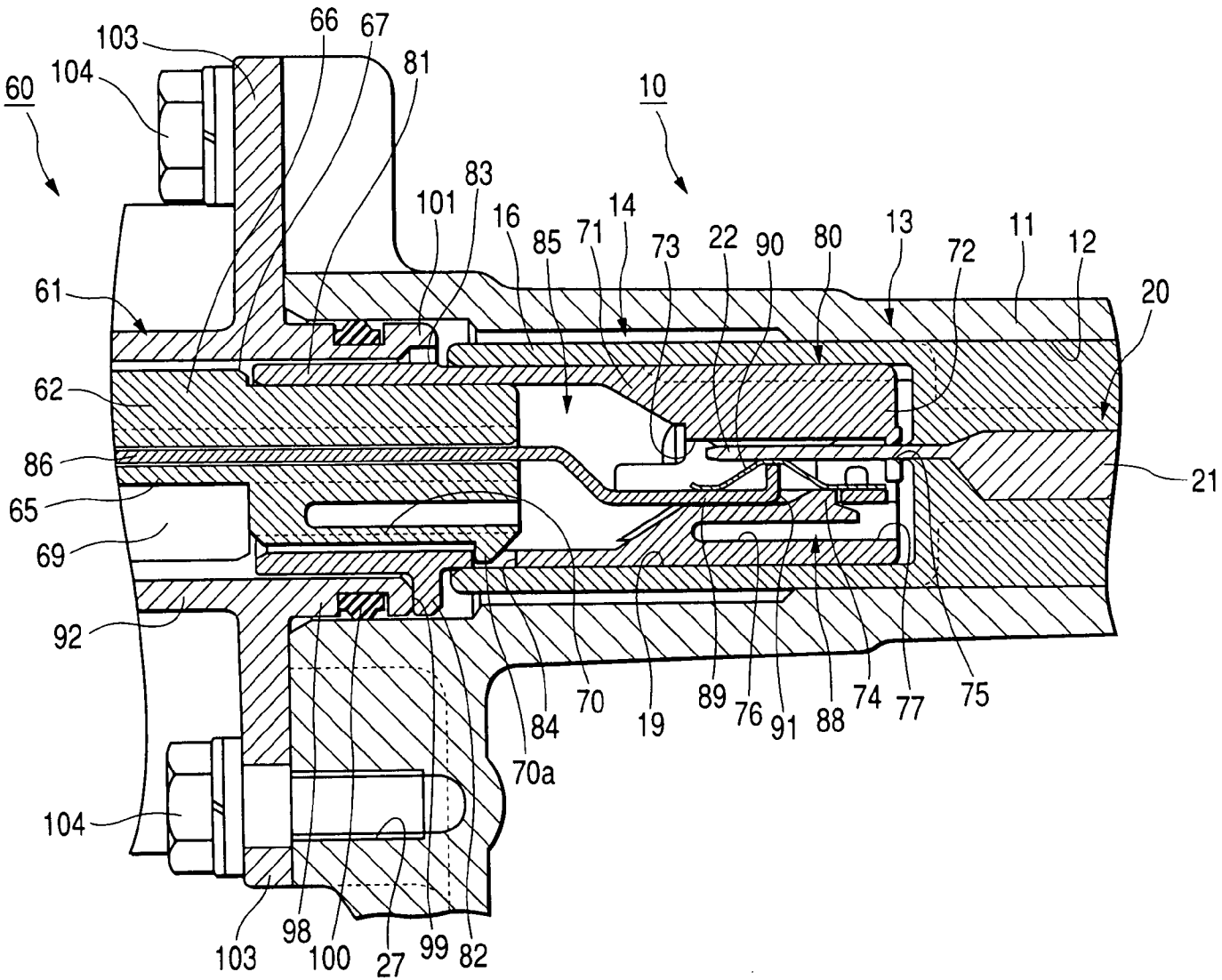
FIG. 3 is an enlarged cross sectional view showing a connection part between the apparatus-side connector and the relay connector.
Figure 4:
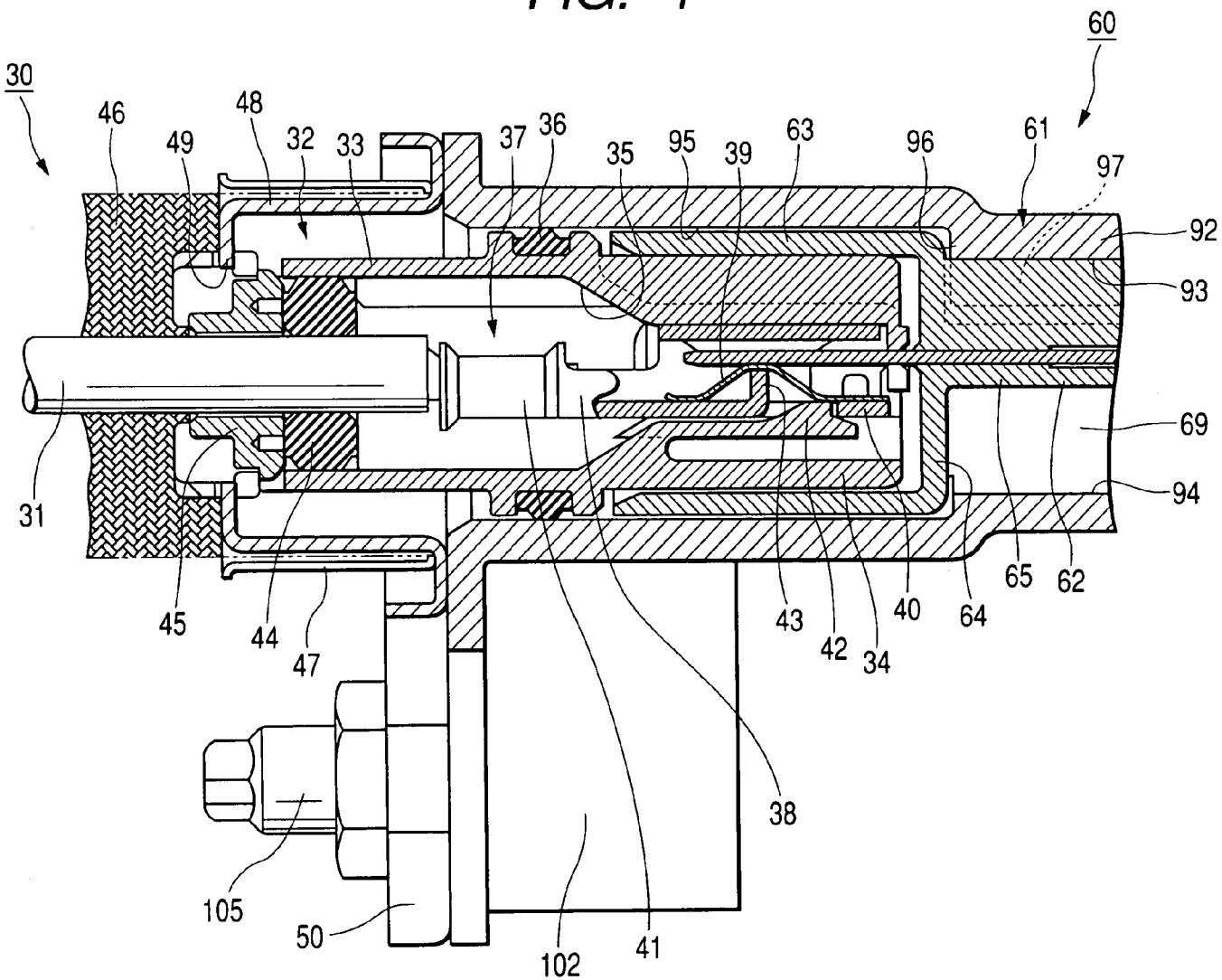
FIG. 4 is an enlarged vertical cross sectional view showing a connection part between the apparatus-side connector and the relay connector.
Figure 5:
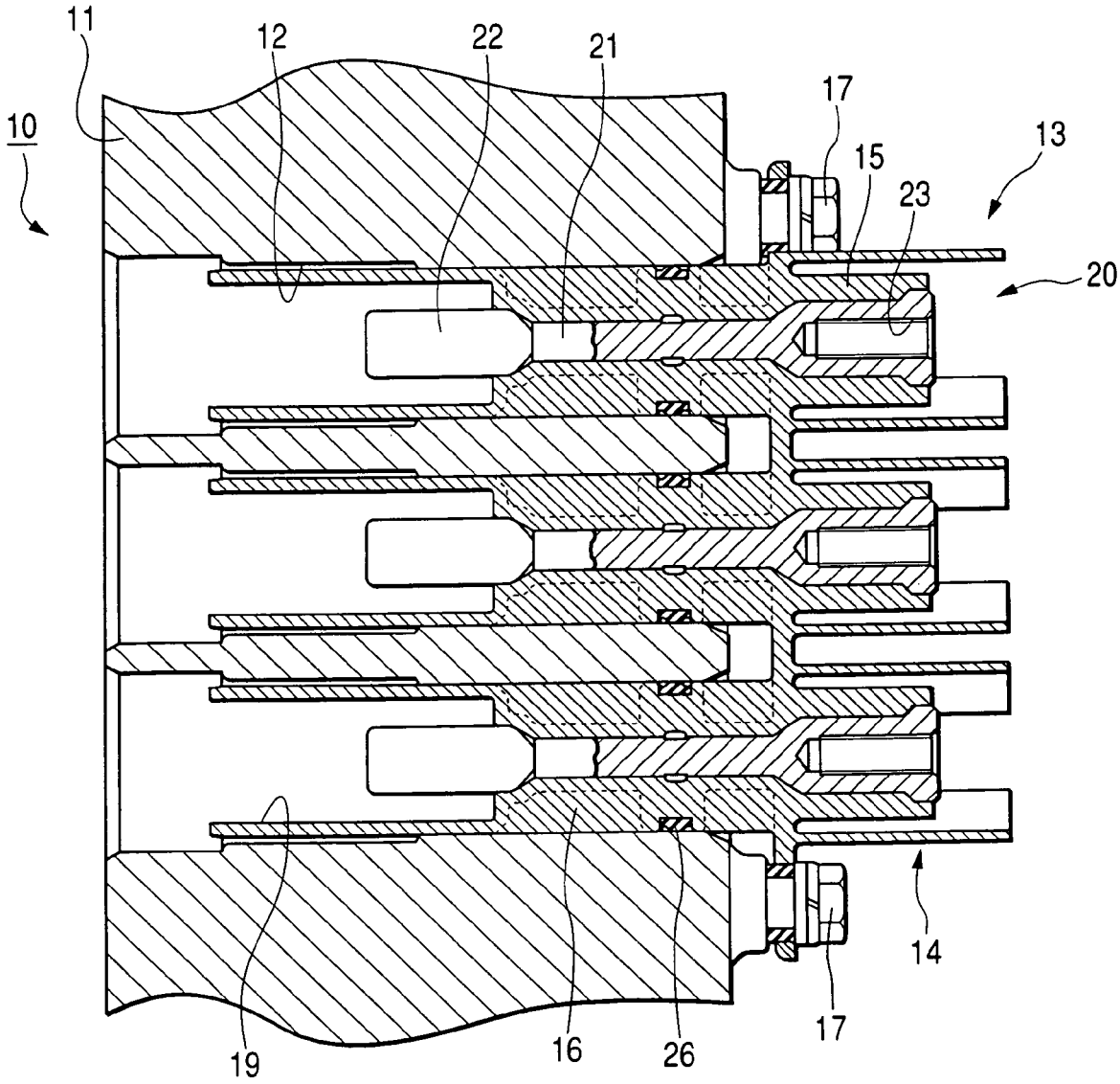
FIG. 5 is a horizontal cross sectional view of the apparatus-side connector.
Figure 6:
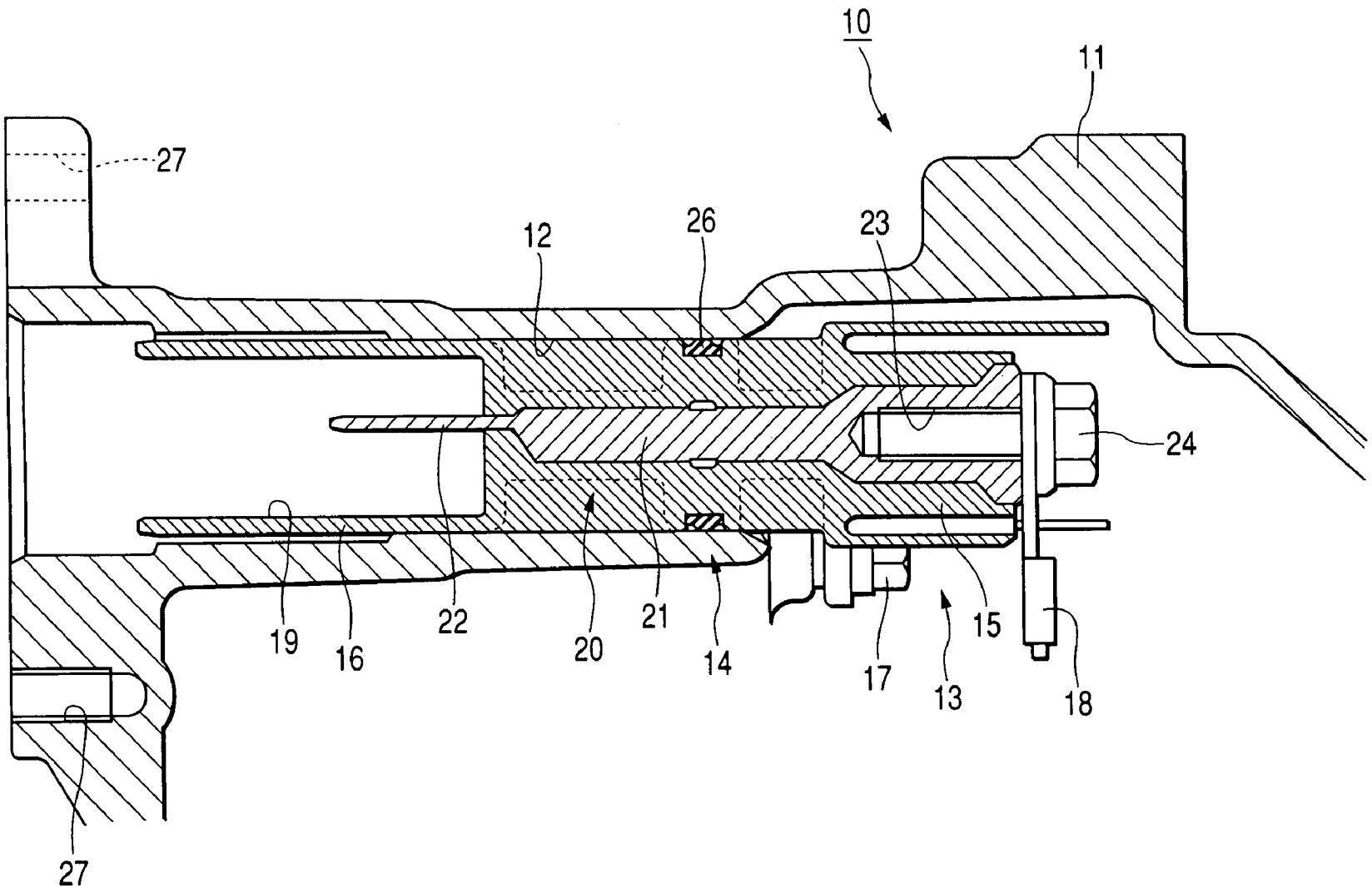
FIG. 6 is a vertical cross sectional view of the apparatus-side connector.
Figure 7:
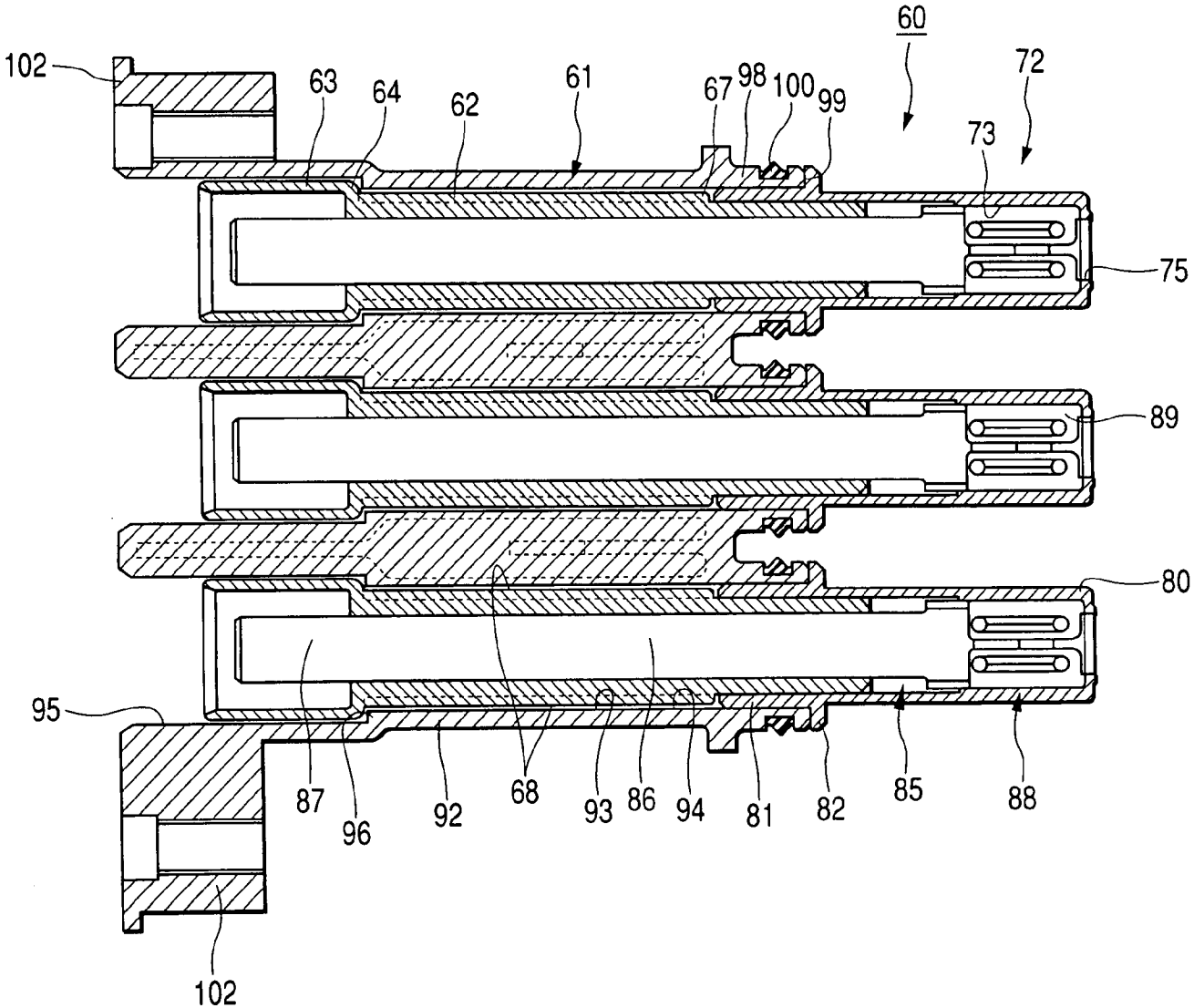
FIG. 7 is a horizontal cross sectional view of the relay connector.
Figure 8:
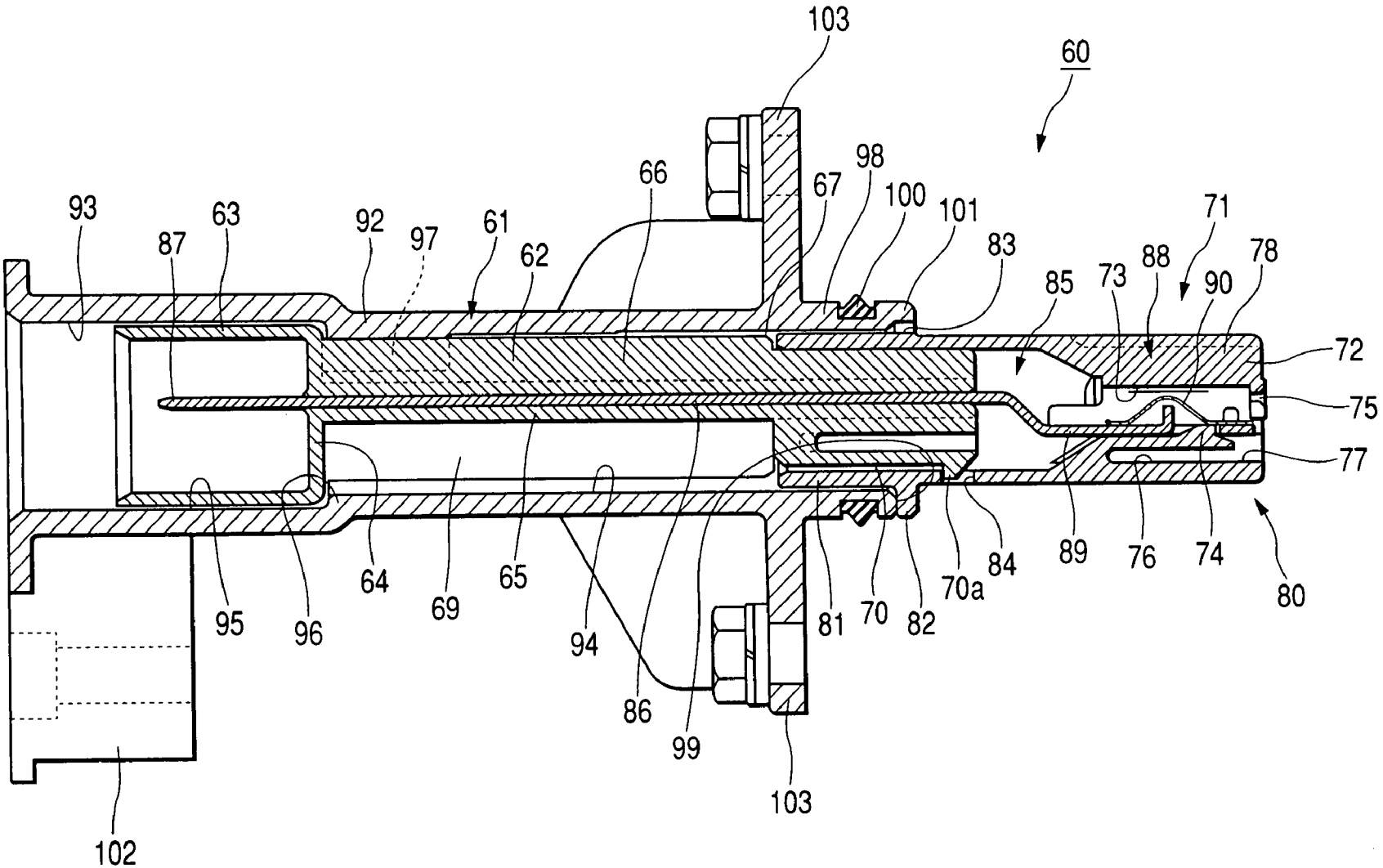
FIG. 8 is a vertical cross sectional view of the relay connector.
Figure 9:
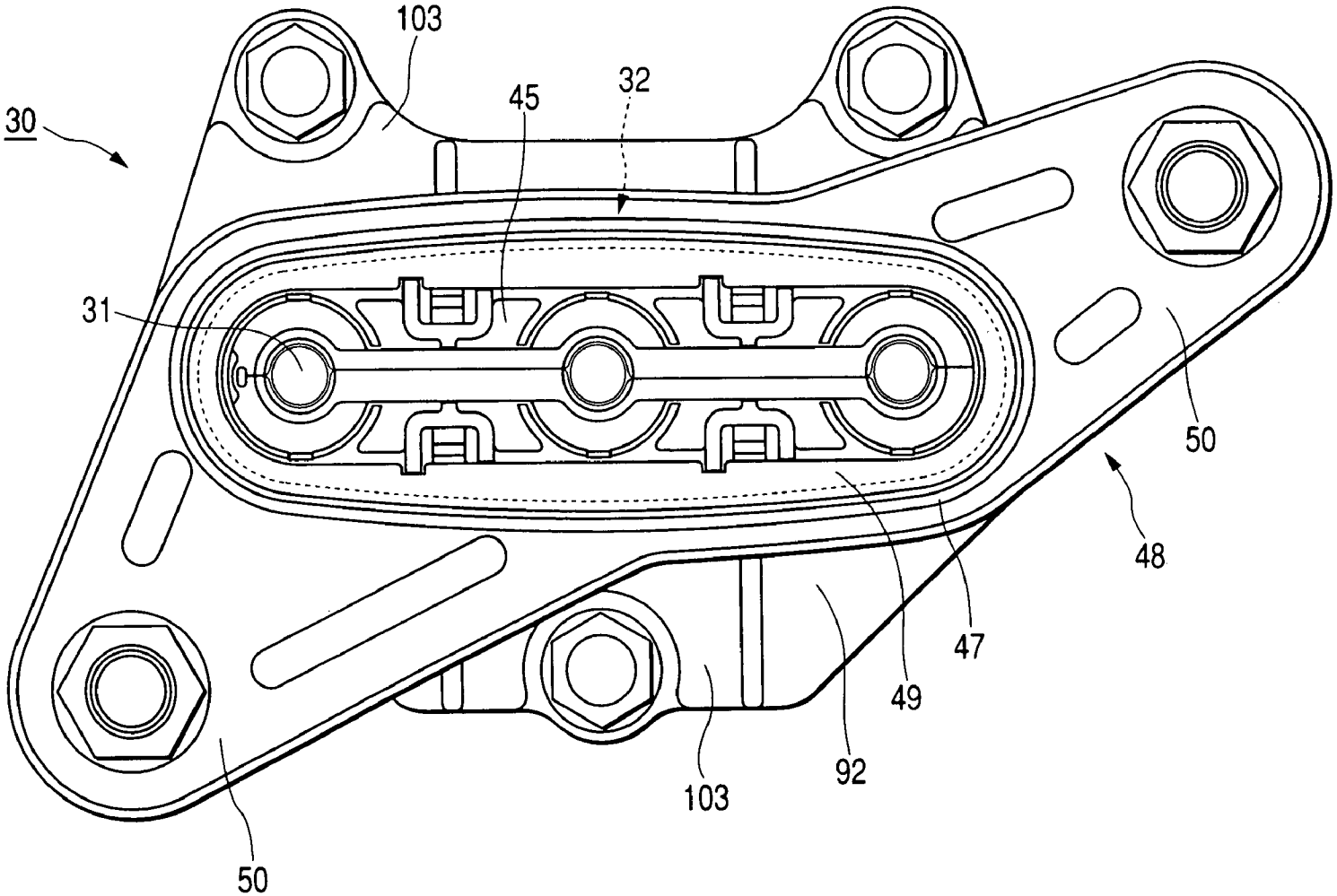
FIG. 9 is a rear view showing a state in which the wire-side connector is connected with the relay connector.
Figure 10:
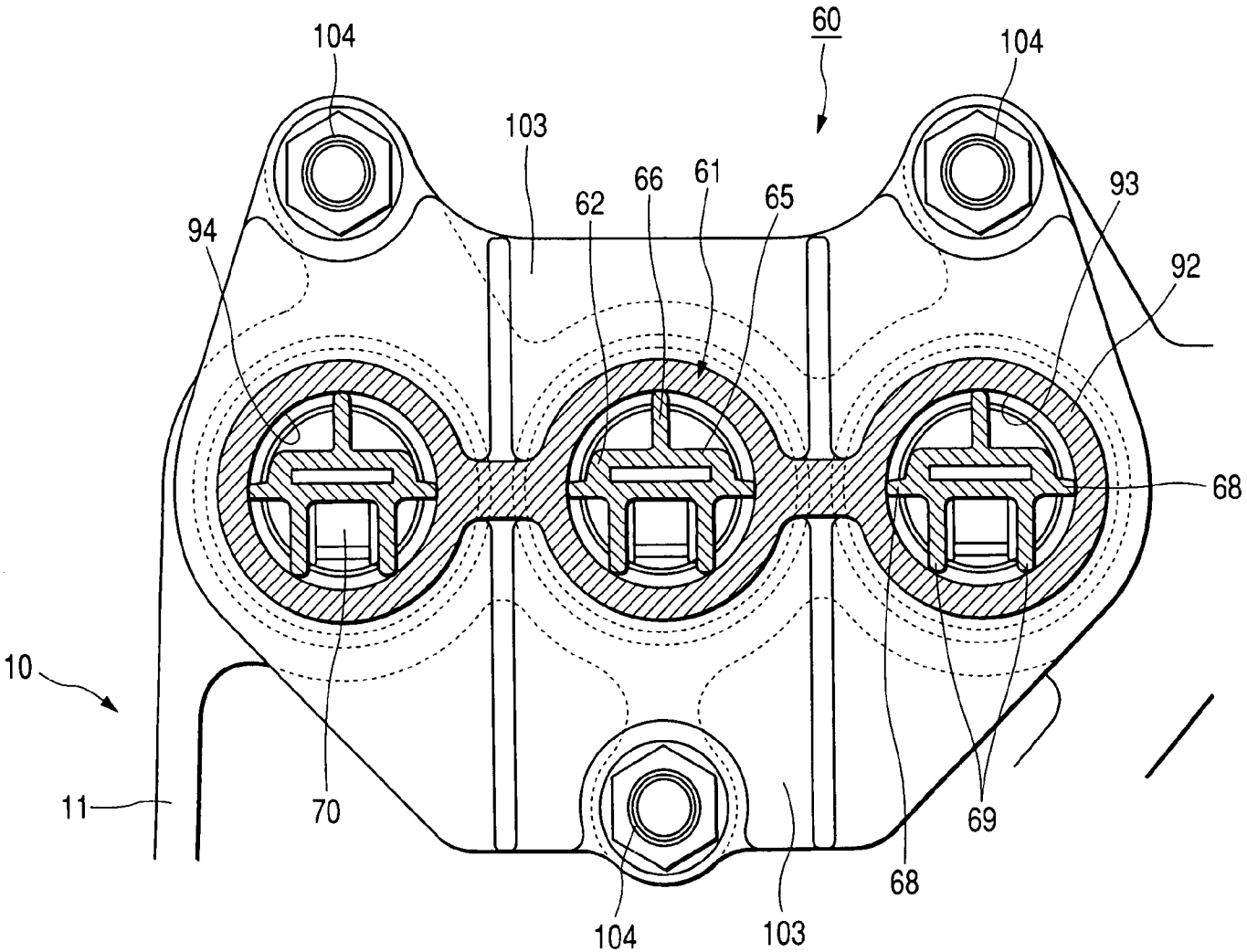
FIG. 10 is a cross sectional view taken along the line A—A of FIG. 1.
Figure 11:
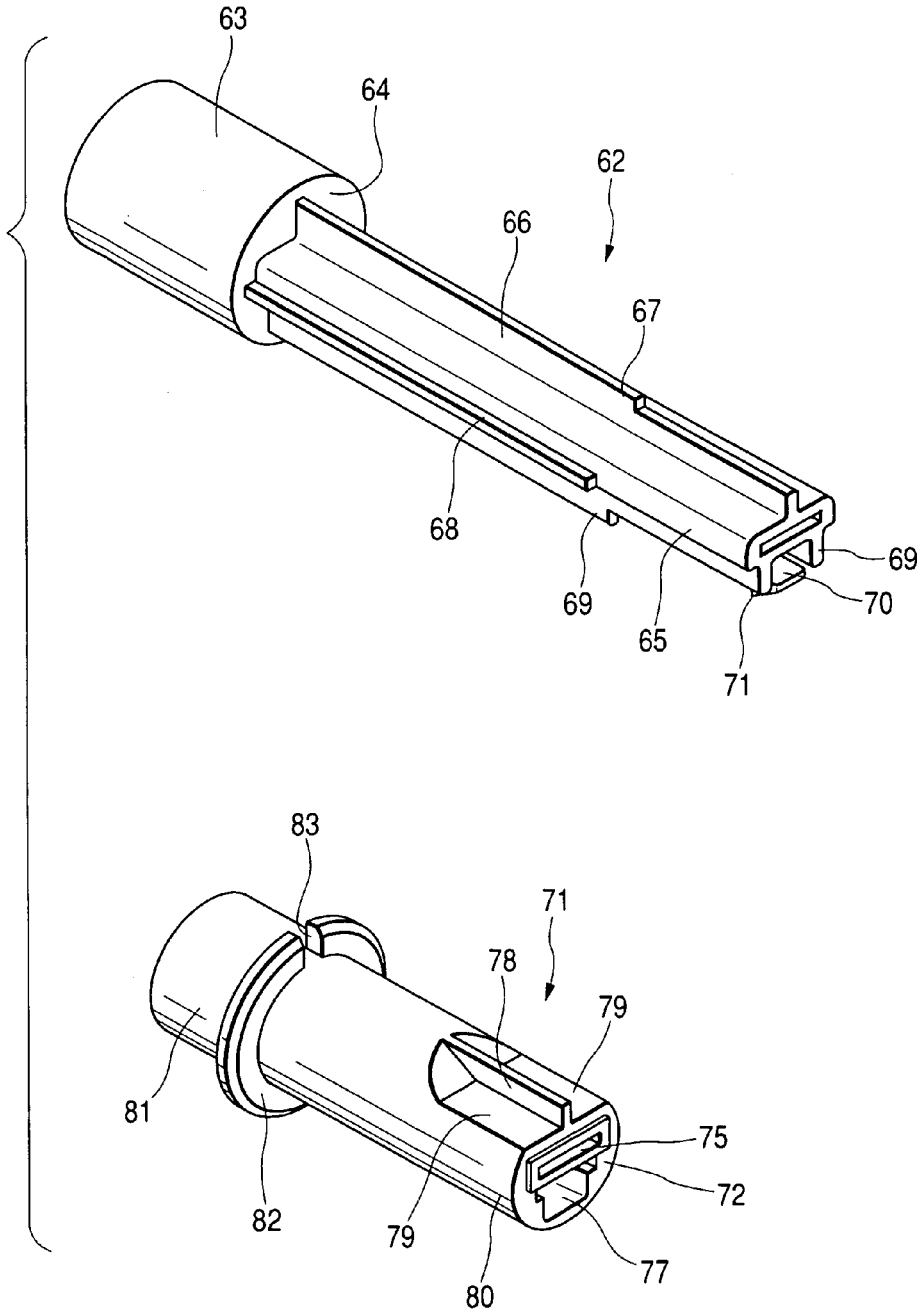
FIG. 11 is a perspective view showing a state in which a first accommodator and a second accommodator are separated from each other.
Figure 12:
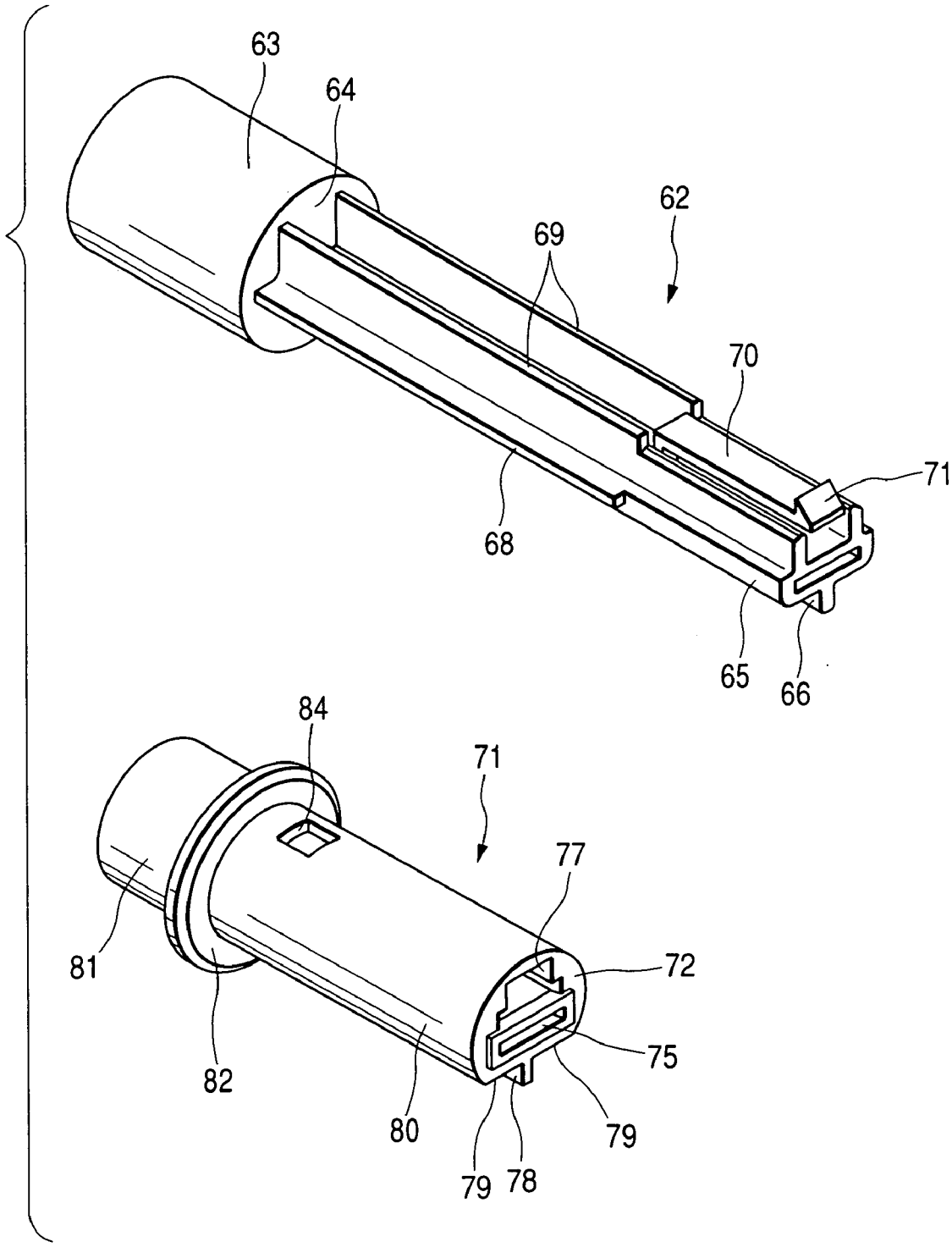
FIG. 12 is a vertically reversed perspective view showing a state in which the first accommodator and the second accommodator are separated from each other.

The following is a description of Embodiment 1 of the present invention with reference to FIGS. 1 to 12.

First, an apparatus 10 (for example, a motor or an inverter of an electric car) and an apparatus-side connector 13 will be described. The apparatus 10 is configured by an unillustrated apparatus main body (for example, a stator in a motor) and an apparatus direct connection terminal 18 directly connected with the apparatus main body which are accommodated in an apparatus-side shield shell 11 (for example, a motor case). On a side wall of the apparatus-side shield shell 11 are three circular attachment holes 12 laterally arranged in a fixed pitch in such a manner as to penetrate the sidewall in the back-and-forth direction (the lateral direction in FIG. 1) and to communicate the outside (the left side in FIG. 1) and inside of the apparatus-side shield shell 11.

The apparatus-side connector 13 is configured by an apparatus-side housing 14 made of synthetic resin, and three apparatus-side terminal metal fittings 20. The apparatus-side housing 14 is formed by extending three circular extension parts 16 from tubular linkage part 15 in a rear direction (towards the left in FIG. 1). Each of the circular extension parts 16 are fitted into the attachment holes 12 from the inside of the apparatus-side shield shell 11, and the linkage part 15 is fixed to the inner surface of the apparatus-side shield shell 11 with bolts 17. The apparatus-side terminal metal fittings 20 are each configured by a terminal main body 21 having a circular cross section, a flat tab 22 formed by placing a plate horizontally at the rear end part of the terminal main body 21, and a female screw part 23 concentrically formed at the front end part of the terminal main body 21. The apparatus-side terminal metal fittings 20 are housed in the respective circular extension parts 16 by insert molding at the time of metallic molding the apparatus-side housing 14. The tabs 22 are accommodated in engagement concave parts 19 which are concentrically formed at the rear end parts of the circular extension parts 16, and are in standby for the connection with the female connection parts 88 of the relay connector 60. The rear ends of the circular extension parts 16 are positioned further inward than (in front of) the opening edges of the attachment holes 12 on the outer surface of the apparatus-side shield shell 11. The female screw parts 23 are exposed on the front end surface of the linkage part 15 inside the apparatus-side shield shell 11, and are connected with the apparatus direct connection terminals 18 with bolts 24. The spacing between the inner circumference of each of the attachment holes 12 and the outer circumference of each of the apparatus-side housings 14 is made waterproof by seal rings 26 provided on the outer circumferences of the circular extension parts 16. The outer surface (rear surface) of the apparatus-side shield shell 11 has female screw holes 27 for fixing the relay shield shell 92 of the relay connector 60.

The following is a description of the wire-side connector 30. The wire-side connector 30 is connected to the front end parts of the three wires 31 which do not have a shield function on a stand-alone basis, and is configured by a wire-side housing 32 made of synthetic resin, three wire-side terminal metal fittings 37, and a wire-side shield shell 48.

The wire-side housing 32 is formed by extending the laterally arranged three circular engagement parts 34 forwards (towards the right in FIG. 1) from a support part 33 shaped like a roughly flattened oval. The three circular engagement parts 34 can be fitted into the three engagement concave parts 19 of the apparatus-side connector 13. The circular engagement parts 34 each have a cavity 35 which opens to the rear end surface of the support part 33, and seal rings 36 are provided on the rear end parts on the outer circumferences of the circular engagement parts 34.

The wire-side terminal metal fittings 37 are each configured by combining a thick-walled terminal main body 38 and a thin-walled elastic contact piece 39 which are molded as separate parts to each other. The roughly front end part of each terminal main body 38 is a square cylinder 40, and the roughly latter part makes a compression adhesion part 41. The elastic contact piece is assembled in a state of being accommodated in the square cylinder 40. The square cylinder 40 and the elastic contact piece 39 compose a connection device connectable with the male connection parts 87 of the relay terminal metal fittings 85 and the tabs 22 of the apparatus-side terminal metal fittings 20. The wire-side terminal metal fittings 37 are connected with the wires 31 in the compression adhesion parts 41, and are inserted into the cavities 35 from behind so as to be prevented from coming off by locking lances 42 formed inside the cavities 35 by lance holes 43 of the square cylinder parts 40. The spacing between the wires 31 and the cavities 35 is made waterproof by rubber stoppers 44 externally fitted to the wires 31, and the rubber stoppers 44 are prevented from coming off by holders 45 provided on the rear-end-side opening part of the apparatus-side housing 14.

The three wires 31 are collectively shielded by a cylindrical shielding member 46 formed by knitting a metal wire into a mesh. The front end part of the shield member 46 is externally fixed to the wire-side shield shell 48 by crimping a crimp ring 47. The wire-side shield shell 48 is provided with a plurality of pressure pieces 49 which project inwards from the rear end edge of the wire-side shield shell 48. The wire-side shield shell 48 is assembled in such a manner that the whole circumference of the wire-side housing 32 is accommodated by the support part 33 in a state where the pressure pieces 49 are brought into contact with the back surface of the support part 33 of the wire-side housing 32 from behind. The wire-side shield shell 48 is provided with two attachment pieces which are laterally arranged and project outwards from the front end edge of the wire-side shield shell 48 as a device for attaching to the relay shield shell 92.

The following is a description of the relay connector 60.

The relay connector 60 is configured by combining three relay housings 61, three relay terminal metal fittings 85, and a relay shield shell 92.

The relay housings 61 are configured by combining the first accommodator 62 made of synthetic resin and the second accommodator 71 also made of synthetic resin.

The first accommodator 62 has a long and narrow shape in the back-and-forth direction as a whole and is provided with a wire engagement part 63 which is shaped like a cylinder opened in the rear direction as a device for engaging with the wire-side housing 32 at the rear end parts. From the center of the support wall 64 formed at the front end of the wire engagement part 63 is straightly extended a square cylinder part 65 having a cross section of a rectangle longer horizontally than vertically, and the inner space of the flat square cross section of the square cylinder part 65 communicates with the wire engagement part 63. On the top surface of the square cylinder part 65 is formed a top surface rib 66 which rises from the center in the width direction and which extends straight in parallel with the square cylinder part 65. The formation area of the top surface rib 66 extends from the support wall 64 of the wire engagement part 63 to the front end of the square cylinder part 65. Concerning the height of the top surface rib 66 from the square cylinder part 65, the front end side is slightly lower than the center in the back-and-forth direction with the step part 67 close to the front end of the square cylinder part 65 as a border. The left and right side surfaces of the square cylinder part 65 are provided with side-surface ribs 68 which project outwards from the center in the height direction of the square cylinder part 65 and which extend straight in parallel with the square cylinder part 65. The formation area of the side-surface rib 68 extends from the support wall 64 of the wire engagement part 63 to the step part 67 of the top surface rib 66. On the bottom surface of the square cylinder part 65 are formed a pair of left and right bottom surface ribs 69 extending straight in parallel with the square cylinder part 65 at two positions closer to the inside than the left and right side edges. The formation area of the bottom surface ribs 69 extends from the support wall 64 of the wire engagement part 63 to the front end of the square cylinder part 65 as in the case of the top surface rib 66. The positions of the bottom end edges of the bottom surface ribs 69 are higher on the front end side with the step part 67 of the top surface rib 66 as a border.

The square cylinder part 65 includes a bending lock piece 70 which extends in a cantilevered manner from a position close to the front end on its bottom surface forwards along the bottom surface and which is sandwiched between the left and right bottom surface ribs 69. The bending lock piece 70 is designed to be elastically bendable in the vertical direction with the support part of the rear end of the bending lock piece 70 as the fulcrum. On the front-end-part bottom surface of the bending lock piece 70 is formed a lock projection 70*a* which projects further downward than the bottom end edge of the bottom surface rib 69.

The second accommodator 71 is shaped like a cylinder as a whole. Its hollow part is opened in the rear direction, and its front surface has a front wall 72. The roughly former part of the hollow of the second accommodator 71 has a cavity 73 of a rectangle longer horizontally than vertically, and below the cavity 73 is formed a lance 74 which extends forwards in a cantilevered manner. The front wall 72 has an insertion opening 75 which is shaped like a rectangle longer horizontally than vertically in such a manner as to penetrate from the outer surface (front end surface) of the front wall 72 to the cavity 73, and also has a die-cutting hole 77 for forming a bending space 76 with the lance 74. The front-end-part top surface part of the second accommodator 71 has a lightened part 79 whose lateral ends are cut so as to leave a reinforcing rib 78 that extends in the back-and-forth direction of the center in the width direction. The lightened part 79 has a horizontal top surface. Thus, the roughly former part of the second accommodator 71, that is, the apparatus engagement part 80, which is the part to be engaged with the wire-side housing 32, has a non-circular cross section both in the inner and outer circumferences because it includes the cavity, the lance, the lightened part, and the reinforcing rib.

On the other hand, the roughly latter half of the second accommodator 71 makes a combining cylindrical part 81 shaped like a cylinder. On the outer circumference of the combining cylindrical part 81 is formed a flange part 82 shaped like a circle concentric with the cylindrical part, and at the top end part of this flange part 82 is formed a positioning cut part 83. In a position a slightly in front of the flange part 82 in the combining cylindrical part 81 is formed a lock part 84 having a square-shaped hole penetrating from the inner circumference to the outer circumference.

The relay terminal metal fittings 85 are each provided with a terminal main body 86 that extends long and narrow in the back-and-forth direction, a female connection part 88 formed on the front end part of the terminal main body 86, and a male connection part 87 formed integrally with the rear end part of the terminal main body 86. The terminal main body 86 is made of a thick-walled metal plate which is horizontal and has a fixed width throughout the length. The terminal main body 86 and the male connection part 87 are connected with each other seamlessly or to form a single plane. The male connection part 87 has the same configuration and size with the tabs 22 of the apparatus-side terminal metal fittings 20.

The female connection part 88 is formed by combining two components: a square cylindrical box-shaped engagement part 89 formed integral with the terminal main body 86 and an elastic contact piece 90 accommodated in the box-shaped engagement part 89. The elastic contact piece 90 is thinner-walled than the terminal main body 86 and is upwardly curved when seen from a side. The elastic contact piece 90 is kept in a manner so as to be accommodated inside the box-shaped engagement part 89 by locking its front end part by the box-shaped engagement part 89. The bottom surface of the box-shaped engagement part 89 has a lance hole 91. The female connection part 88 has the same configuration and size as the connection device configured by the square cylinder part 40 and the elastic contact piece 39 of the wire-side terminal metal fitting 37.

In the border between the female connection part 88 and the terminal main body 86, the terminal main body 86 is bent like a step, thereby making the height of the terminal main body 86 and the male connection part 87 nearly equal to the height of the center of the female connection part 88.

The relay sealed shell 92 is a one-piece die cast product (for example, made of an aluminum alloy), and has a flat shape as a whole. Inside the relay shield shell 92 are formed three penetration spaces 93 with a circular cross section which penetrate in the back-and-forth direction and are laterally arranged in a fixed pitch. The penetration spaces 93 are configured by a small-diameter part 94 occupying a long region extending from its front end to a position close to the rear end, and a large-diameter part 95 having a larger inner diameter than the small-diameter part 94 and occupying the rear end part region of the penetration space 93 (shorter region than the small-diameter part 94). The small-diameter part 94 and the large-diameter part 95 are consecutive in a concentric manner, and the border between the small-diameter part 94 and the large-diameter part 95 makes a rear part stopper 96 which is configured like a step continuous throughout the circumference. At the top end part of the inner surface of the small-diameter part 94 is formed a pair of left and right positioning ribs 97 with a prescribed length extending forwards from the rear part stopper 96.

The front end surface of the relay shield shell 92 includes forwardly projecting cylindrical engagement parts 98 having inner circumferences which are cylindrically shaped and which are continuous with the respective penetration spaces 93 concentrically and with the same diameter. The front end surface of each of the cylindrical engagement parts 98 makes a front part stopper 99. The outer circumference of the cylindrical engagement part 98 is provided with a seal ring 100. At the top end on the front end surface of the cylindrical engagement part 98 is formed a forwardly-projecting positioning projection 101.

In the rear end part of the relay shield shell 92 are formed two wire contact parts 102 which extend in the shape of plates both in the diagonally upper right and diagonally lower left directions so as to correspond to the attachment pieces 50 of the wire-side shield shell 48 as a device for contacting with the wire-side shield shell 48. In addition, on the front end part of the relay shield shell 92 are formed two apparatus contact parts 103 which project in the shape of plates both upwardly and downwardly so as to correspond to the female screw holes 27 of the apparatus-side shield shell 11 as a device for contacting with the apparatus-side shield shell 11.

The assembly of the relay connector 60 is carried out as follows. First, the male connection parts 88 of the three wire-side terminal metal fittings 37 are inserted into the cavities 73 of the second accommodator 71 from behind, so as to strike the front ends of the female connection parts 88 into the front wall 72 of the second accommodator 71. As a result, the female connection parts 88 are prevented from coming off by locking the lance hole 91 by the lance 74 of the cavity 73, thereby assembling the wire-side terminal metal fittings 37 and the second accommodator 71. In an assembled state, the front end parts of the relay terminal metal fittings 85, that is, the female contact parts 88 are accommodated inside the second accommodator 71; however, most of the terminal main body 86 and the male connection part 87 are projected from the second accommodator 71 outside in the rear direction.

Next, the first accommodator 62 is inserted from behind into the three penetration spaces 93 of the relay shield shell 92. In this case, the first accommodator 62 is positioned in the circumferential direction with respect to the relay shield shell 92 (penetration spaces 93) by fitting the top surface rib 66 in between the two positioning ribs 97. The fitted first accommodator 62 is stopped in the regular insertion position by striking the front-end outer edge of the wire engagement part 63 into the rear end stopper 96. In this state, the square cylinder part 40, the top surface rib 66, the side surface rib 68, and the bottom surface rib 69 are accommodated in the small-diameter part 94, whereas the wire engagement part 63 is accommodated in the large-diameter part 95. The rattling of the first accommodator 62 in the diameter direction with respect to the penetration spaces 93 is reduced by bringing the top surface rib 66, the side surface rib 68, and the bottom surface rib 69 into contact with the inner circumference of the small-diameter part 94, and by bringing the outer circumference of the wire engagement part 63 into contact with the inner circumference of the large-diameter part 95. The rear end of the wire engagement part 63 is positioned further inward than (in front of) the rear end opening of the large-diameter part 95, and the front end part of the first accommodator 62 penetrates the penetration spaces 93 and slightly projects in front of the relay shield shell 92.

After the fitting of the first accommodator 62, the second accommodator 71 and the relay terminal metal fittings 85 are assembled from in front of the relay shield shell 92 and the first accommodator 62. In this assembly, first of all, the male connection part 87 at the rear end of the relay terminal metal fitting 85 is inserted from in front of the square cylinder part 65 projecting from the penetration space 93, and then the terminal main body 86 is inserted into the square cylinder part 65. The male connection part 87 and the terminal main body 86 inserted into the square cylinder part 65 are fitted without causing rattling in any direction with respect to the square cylinder part 65.

When the male connection part 87 and the terminal main body 86 are further inserted, the combining cylindrical part 81 of the second accommodator 71 is inserted into the clearance between the small-diameter part 94 of the penetration space 93 and the front end part of the first accommodator 62. At this moment, the combining cylindrical part 81 makes contact with the inner circumference of the small-diameter part 94, so that there is no rattling caused in the diameter direction. In the process of insertion, the bottom end part of the inner circumference of the combining cylindrical part 81 comes into contact with the bending lock piece 70, thereby elastically bending the bending lock piece 70 upwards. Immediately before the second accommodator 71 and the relay terminal metal fittings 85 reach the regular insertion positions, the second accommodator 71 is positioned in the circumferential direction by fitting the positioning cut part 83 into the positioning projection 101 of the relay shield shell 92.

Then, when fitted into the regular insert-ion-positions, the second accommodator 71 and the relay terminal metal fittings 85 are stopped by the flange part 82 of the second accommodator 71 coming into contact with the front part stopper 99 from in front. At the same time, the bending lock piece 70 of the first accommodator 62 is returned to its original shape so as to fit the lock projection 70*a* into the lock part 84 of the second accommodator 71. Consequently, the first accommodator 62 and the second accommodator 71 are combined with each other so as to control the separation from each other in the back-and-forth direction, thereby composing the relay housing 61. On the inner circumference of the combining cylindrical part 81 of the second accommodator 71, the top surface rib 66, the side surface rib 68, and the bottom surface rib 69 of the first accommodator 62, and the square edge of the square cylinder part 65 make contact with each other in the diameter direction, so that the rattling between the accommodators 62 and 71 in the diameter direction is controlled.

When the accommodators 62 and 71 are combined, the forward relative movement of the first accommodator 62 and the backward relative movement of the second accommodator 71 are controlled with respect to the relay shield shell 92. In other words, the two accommodators 62 and 71, which are in a combined state so as to control their separation in the back-and-forth direction, sandwich the relay shield shell 92 from the front and back sides so that the two accommodators 62 and 71 (that is, the relay housing 61) are integrally-combined with the relay shield shell 92. Furthermore, the male connection part 87 of the relay terminal metal fitting 85 is positioned inside the wire engagement part 63, and the apparatus engagement part 80 of the second accommodator 71 projects in front of the cylindrical engagement part 98 of the relay shield shell 92. Thus, the assembly of the relay connector is complete.

This relay connector 60 is connected with the apparatus-side connector 13 prior to the connection with the wire-side connector 30 in advance. In this connection, the front end part of the relay connector 60, that is, the apparatus engagement part 80 of the relay housing 61 and the cylindrical engagement part 98 of the relay shield shell 92 are inserted into the attachment holes 12 of the apparatus-side connector 13. When inserted as far as the regular positions, the apparatus engagement part 80 is fitted into the engagement concave parts 19 of the apparatus-side housing 14 without causing rattling in the diameter direction, thereby putting the housings 14 and 61 into a regular engagement state. In addition, the tabs 22 come into the apparatus engagement part 80 so as to make elastic contact with the elastic contact pieces 90 of the female connection parts 88, thereby putting both terminal metal fittings 20 and 85 in a state of being conductively connected. At the same time, the clearance between the outer circumference of the cylindrical engagement parts 98 of the relay shield shell 92 and the inner circumference of the attachment holes 12 is made waterproof with seal rings. Since the front end surface of the apparatus contact part 103 of the relay shield shell 92 comes into contact with the apparatus-side shield shell 11, after this, the apparatus contact part 103 is conductively fixed to the apparatus-side shield shell 11 with bolts 104.

Thus, the connection of the relay connector 60 with the apparatus-side connector 13 is complete. In this state, the rear end part of the relay connector 60, that is, the wire engagement part 63, the male connection part 87, and the wire contact part 102 standby at positions away from the apparatus-side connector 13 for the connection with the wire-side connector 30.

Then, the wire-side connector 30 is connected with the rear end part of the relay connector 60. In this connection, first of all, each of the circular engagement parts 34 of the wire-side housing 32 is fitted into the wire engagement parts 63 of the relay housing 61 in the penetration spaces 93. When the circular engagement parts 34 are fitted as far as the regular positions, the male connection part 87 of the relay terminal metal fitting 85 comes into the square cylinder part 40 of the wire-side terminal metal fitting 37 so as to make elastic contact with the elastic contact piece 39. In addition, the clearance between the outer circumference of the wire-side housing 32 and the inner circumference of the large-diameter part 95 of the penetration space 93 is made waterproof with seal rings 36. Next, the wire-side shield shell 48 is combined from behind with the relay shield shall 92. At this moment, the pressure pieces 49 of the wire-side shield cell 48 are brought into contact with the support part 33 of the wire-side housing 32 from behind, thereby controlling the backward separation of the wire-side housing 32 from the relay housing 61. The two attachment pieces 50 of the wire-side shield shell 48 are brought into contact with the wire contact parts 102 of the relay shield shell 92 from behind, thereby conductively fixing both shield shells 48 and 92 by the bolt 105. Thus, the connection of the wire-side connector 30 with the relay connector 60 is complete, and the wire-side connector 30 is connected with the apparatus-side connector 13 via the relay connector 60.

When the relay connector 60 is exploded for maintenance or other reasons, a jig (not illustrated) is inserted into the lock part 84 positioned in front of the relay shield shell 92 so as to elastically bend the bending lock piece 70 to be released from the lock part 84, and in this state the first and second accommodators 62 and 71 are separated from each other in the back-and-forth direction. As a result, the combination of these accommodators 62 and 71 are released, at the same time, both accommodators 62 and 71 (relay housing 61) are detached from the relay shield shell 92. Since the relay terminal metal fittings 85 are separated from the first accommodator 62 and held in the second accommodator 71, a jig (not illustrated) is inserted into the die-cutting space 77 from in front of the second accommodator 71 to elastically bend the lance 74 to be released from the wire-side terminal metal fittings 37. In this state, the wire-side terminal metal fittings 37 are pulled in the rear direction to be released from the second accommodator 71.

When the relay housing 61 of the present embodiment is unnecessary, the wire-side connector 30 can be fitted directly into the apparatus-side connector 13. In this case, the wire-side shield shell 48 must be replaced by another having attachment pieces corresponding to the female screw parts 27 of the apparatus-side shield shell 11; however, other components can be used as they are. To be more specific, the circular engagement parts 34 of the wire-side housing 32 can be fitted into the engagement concave parts 19 of the apparatus-side housing 14, and the clearance between the outer circumference of the wire-side housing 32 and the inner circumferences of the attachment holes 12 of the apparatus 10 can be made waterproof with the seal rings 36 of the wire-side housing 32. Furthermore, the wire-side terminal metal fitting 37 can be directly fitted into the apparatus-side terminal metal fitting 20 so as to be put in a conductively connected state.

As described hereinbefore, in the present embodiment, when the front end part of the relay connector 60 is connected with the apparatus-side connector 13, and the rear end part of the relay connector 60 is positioned within reach of the operator, even if the apparatus 10 is positioned out of reach of the operator, the wire-side connector 30 can be connected to the apparatus 10-side connector without changing the configurations and structures of the apparatus 10 and the apparatus-side connector. 13.

The relay terminal metal fittings 85 each include the long and narrow terminal main body 86, the male connection part 87 formed at the rear end of the terminal main body 86, and the female connection part 88 provided on the front end of the terminal main body 86. If the relay terminal metal fittings 85 are intended to be housed into the relay housing with a one-piece structure, it is necessary that the relay housing contain a large insertion space for inserting the female connection part 88 thereinto, and this causes the long and narrow terminal main body 86 to rattle inside the insertion space. However, according to the present invention, the relay housing 61 is divided into the first and second accommodators 62 and 71, and makes the second accommodator 71 accommodate the female connection part 88, and also makes the first accommodator 62 accommodate the long and narrow terminal main body 86 and the male connection part 87 in an inserted state, thereby preventing rattling of the terminal main body 86 in the diameter direction.

Since the first accommodator 62 and the second accommodator 71 are combined in a state of sandwiching the relay shield shell 92, it is unnecessary to provide a lock structure for controlling the individual separation of the first and second accommodators 62 and 71 from the relay shield shell.

The device for keeping the two accommodators 62 and 71 in a combined state is configured by a lock structure having the bending lock piece 70 that is elastically bendable and the lock part 84 that is locked by the bending lock piece 70. This can set the accommodators 62 and 71 in a combined state with a single motion, and the combined state can be released only by detaching the bending lock piece 70 from the lock part 84 by elastically bending the bending lock piece 70.

The bending lock piece 70 and the locking piece 84 are disposed outside the relay shield shell 92 when the relay housing 61 is combined with the relay shield shell 92, and the opening part of the lock part 84 can be made a visual inspection (the insertion of the jig) from outside the relay shield shell 92, thereby facilitating operation to release the bending lock piece 70 from the lock part 84.

The present invention is not limited to the embodiment described above with the drawings. The following embodiments are included in the technical scope of the present invention, and other various modifications can be performed without departing from the spirit of the invention.

(1) In the aforementioned embodiment, the relay connector has a straight shape as a whole; however, according to the present invention, the relay connector can be curved, L-shaped, bent at an obtuse angle, bent at an acute angle, or complicatedly shaped by combining these shapes two or three dimensionally.

(2) In the aforementioned embodiment, the plural relay housings are collectively housed in the single relay shield shell; however, according to the present invention, only one relay housing can be housed in a single relay shield shell.

(3) In the aforementioned embodiment, the connection part of one end side of the relay terminal metal fittings has a male configuration, and the connection part of the other end side has a female configuration; however, according to the present invention, both ends can be male-configured or female-configured.

(4) In the aforementioned embodiment, each relay housing is configured by two components; however, according to the present invention, it can be configured by one component or three or more components.

(5) In the aforementioned embodiment, the device for locking two accommodators into a combined state is disposed outside the relay shield shell; however, according to the present invention, the lock device can be housed inside the relay shield shell.

(6) In the aforementioned embodiment, the relay housings are integrated with the relay shield shell by sandwiching the relay shield shell between the two accommodators from front and back; however, according to the present invention, it is possible to compose the relay shield shell by two components and to sandwich the relay housings between the two components.

(7) In the aforementioned embodiment, the relay shield shell is made of a single component; however, according to the present invention, the relay shield shell can be configured by multiple components.

(8) In the aforementioned embodiment, plural non-shield wires are collectively accommodated by a shielding member; however, according to the present invention, it is possible to use shield wires provided with a shielding function and to connect the shield wires individually with the wire-side shield shell.

(9) In the aforementioned embodiment, the apparatus-side terminal metal fittings are male-configured, and the wire-side terminal metal fittings are female-configured; however, according to the present invention, the apparatus-side terminal metal fittings can be female-configured, and the wire-side terminal metal fittings can be male-configured.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A relay connector for connecting (i) an apparatus-side connector which is fixed to an apparatus and which holds an apparatus-side terminal metal fitting in an apparatus-side housing and (ii) a wire-side connector which holds a wire-side terminal metal fitting connected to a wire in a wire-side housing, the relay connector comprising:

a relay terminal metal fitting having a first end and a second end, with the first end including a connection part to be connected with the apparatus-side terminal metal fitting and the second end including a connection part to be connected with the wire-side terminal metal fitting;

a relay housing which houses the relay terminal metal fitting and which has a first end and a second end, the first end including an engagement part to be engaged with the apparatus-side housing and the second end including an engagement part to be engaged with the wire-side housing; and a relay shield shell which accommodates the relay housing and which has a first end and a second end, the first end including a contact part to be contacted with an apparatus-side shield shell formed on the apparatus and the second end including a contact part to be contacted with the wire-side shield shell which accommodates a wire-side housing, wherein the relay terminal metal fitting includes a terminal main body, a first connection part is formed at one end of the terminal main body, the first connection part has a male configuration, and a second connection part is formed at the other end of the terminal main body, the second connection part has a female configuration, and the relay housing is configured by combining a first accommodator which contacts the terminal main body and accommodates the first connection part with the male configuration in a penetrated state, and a second accommodator which accommodates the second connection part with the female configuration.

2. An assembly, comprising:

the relay connector of claim 1;

an apparatus-side connector which is fixed to an apparatus and which holds an apparatus-side terminal metal fitting in an apparatus-side housing; and a wire-side connector which holds a wire-side terminal metal fitting connected to a wire in a wire-side housing.

3. The relay connector according to claim 1, wherein the relay shield shell has a penetration space for housing the relay housing, and the first accommodator which has been assembled to the relay shield shell from one end side of the penetration space and the second accommodator which has been assembled to the relay shield shell from the other end side of the penetration space are combined with each other in a state of sandwiching the relay shield shell.

4. An assembly, comprising:

the relay connector of claim 3;

an apparatus-side connector which is fixed to an apparatus and which holds an apparatus-side terminal metal fitting in an apparatus-side housing; and a wire-side connector which holds a wire-side terminal metal fitting connected to a wire in a wire-side housing.

5. The relay connector according to claim 1, wherein the first accommodator and the second accommodator are kept in a combined state by locking between a bending lock piece which is provided in one of the first accommodator and the second accommodator and which is elastically bendable, and a lock part provided in the other accommodator.

6. An assembly, comprising:

the relay connector of claim 5;

an apparatus-side connector which is fixed to an apparatus and which holds an apparatus-side terminal metal fitting in an apparatus-side housing; and a wire-side connector which holds a wire-side terminal metal fitting connected to a wire in a wire-side housing.

7. The relay connector according to claim 5, wherein the bending lock piece and the lock part are positioned outside the relay shield shell in a state in which the relay housing is assembled to the relay shield shell.

8. An assembly, comprising:

the relay connector of claim 7;

an apparatus-side connector which is fixed to an apparatus and which holds an apparatus-side terminal metal fitting in an apparatus-side housing; and a wire-side connector which holds a wire-side terminal metal fitting connected to a wire in a wire-side housing.

9. A relay connector for connecting (i) an apparatus-side connector which is fixed to an apparatus and which holds an apparatus-side terminal metal fitting in an apparatus-side housing and (ii) a wire-side connector which holds a wire-side terminal metal fitting connected to a wire in a wire-side housing, the relay connector comprising:

a relay terminal metal fitting having a first end and a second end, with the first end including a connection part to be connected with the apparatus-side terminal metal fitting and the second end including a connection part to be connected with the wire-side terminal metal fitting;

a relay housing which houses the relay terminal metal fitting and which has a first end and a second end, the first end including an engagement part to be engaged with the apparatus-side housing and the second end including an engagement part to be engaged with the wire-side housing; and a relay shield shell which accommodates the relay housing and which has a first end and a second end, the first end including a contact part to be contacted with an apparatus-side shield shell formed on the apparatus and the second end including a contact part to be contacted with the wire-side shield shell which accommodates a wire-side housing, wherein:

the relay terminal metal fitting includes a terminal main body, a first connection part is formed at one end of the terminal main body, the first connection part has a male configuration, a second connection part is formed at the other end of the terminal main body, the second connection part has a female configuration, the relay housing is configured by combining a first accommodator which accommodates the terminal main body and the first connection part with the male configuration in a penetrated state, and a second accommodator which accommodates the second connection part with the female configuration, the relay shield shell has a penetration space for housing the relay housing, and the first accommodator which has been assembled to the relay shield shell from one end side of the penetration space and the second accommodator which has been assembled to the relay shield shell from the other end side of the penetration space are combined with each other in a state of sandwiching the relay shield shell.

10. An assembly, comprising:

the relay connector of claim 9;

an apparatus-side connector which is fixed to an apparatus and which holds an apparatus-side terminal metal fitting in an apparatus-side housing; and a wire-side connector which holds a wire-side terminal metal fitting connected to a wire in a wire-side housing.

11. A relay connector for connecting (i) an apparatus-side connector which is fixed to an apparatus and which holds an apparatus-side terminal metal fitting in an apparatus-side housing and (ii) a wire-side connector which holds a wire-side terminal metal fitting connected to a wire in a wire-side housing, the relay connector comprising:

a relay terminal metal fitting having a first end and a second end, with the first end including a connection part to be connected with the apparatus-side terminal metal fitting and the second end including a connection part to be connected with the wire-side terminal metal fitting;

a relay housing which houses the relay terminal metal fitting and which has a first end and a second end, the first end including an engagement part to be engaged with the apparatus-side housing and the second end including an engagement part to be engaged with the wire-side housing; and a relay shield shell which accommodates the relay housing and which has a first end and a second end, the first end including a contact part to be contacted with an apparatus-side shield shell formed on the apparatus and the second end including a contact part to be contacted with the wire-side shield shell which accommodates a wire-side housing, wherein:

the relay terminal metal fitting includes a terminal main body, a first connection part is formed at one end of the terminal main body, the first connection part has a male configuration, a second connection part is formed at the other end of the terminal main body, the second connection part has a female configuration, the relay housing is configured by combining a first accommodator which accommodates the terminal main body and the first connection part with the male configuration in a penetrated state, and a second accommodator which accommodates the second connection part with the female configuration, and the first accommodator and the second accommodator are kept in a combined state by locking between a bending lock piece which is provided in one of the first accommodator and the second accommodator and which is elastically bendable, and a lock part provided in the other accommodator.

12. An assembly, comprising:

the relay connector of claim 11;

an apparatus-side connector which is fixed to an apparatus and which holds an apparatus-side terminal metal fitting in an apparatus-side housing; and a wire-side connector which holds a wire-side terminal metal fitting connected to a wire in a wire-side housing.

13. The relay connector according to claim 11, wherein the bending lock piece and the lock part are positioned outside the relay shield shell in a state in which the relay housing is assembled to the relay shield shell.

14. An assembly, comprising:

the relay connector of claim 13;

an apparatus-side connector which is fixed to an apparatus and which holds an apparatus-side terminal metal fitting in an apparatus-side housing; and a wire-side connector which holds a wire-side terminal metal fitting connected to a wire in a wire-side housing.

* * * * *